United States Patent [19]

Bieli-Möschlin et al.

[11] Patent Number: 4,555,926

[45] Date of Patent: Dec. 3, 1985

[54] EQUIPMENT FOR THE REPAIR OF, IN PARTICULAR FOR CORRECTING DENTS OR BULGES IN, CONTAINERS

[76] Inventors: Ruedi Bieli-Möschlin, Hauptstrasse 46, CH-4107 Ettingen; Alois Hurschler-Flury, Rütiweg 357, CH-4245 Kleinlützel, both of Switzerland

[21] Appl. No.: 571,246

[22] Filed: Jan. 16, 1984

[30] Foreign Application Priority Data

Jan. 21, 1983 [CH] Switzerland ..... 436/83

[51] Int. Cl.[4] ..... B21D 1/08

[52] U.S. Cl. ..... 72/392; 72/447; 72/705

[58] Field of Search ..... 72/392, 447, 705; 280/5.2, 5.28, 5.3

[56] References Cited

U.S. PATENT DOCUMENTS 882,492 3/1908 Clossey ..... 72/447
3,649,981 3/1972 Woodworth ..... 280/5.2
4,400,968 8/1983 Barbieri ..... 72/705

FOREIGN PATENT DOCUMENTS 978970 12/1982 U.S.S.R. ..... 72/447

*Primary Examiner*—Lowell A. Larson
*Attorney, Agent, or Firm*—Flynn, Thiel, Boutell & Tanis

[57] ABSTRACT

An adjustable height beam support (11, 12) is fastened to a frame (1) mounted on wheels (6 to 9); a vertically moveable sliding carriage (14) carries a rotatably mounted pressure beam (13). By means of double-acting hydraulic cylinders, two pressure arms (13*a*, 13*b*) slidingly mounted on the pressure beam (13) can press outwards against the container side walls or—with the pressure beam set vertically—against the bottom and the top of the container. Deformations of the container walls can, in this manner, be corrected without large expenditure of time and money. A mobile hydraulic cylinder (23) can be applied to both the frame (1) for moving the equipment into the container and to the pressure beam (13).

12 Claims, 13 Drawing Figures

21
23c
23b
23
23a
43
48
19
1
46
44
45
28
29
6
47
42
49
46
8
h 1
23
43
48
45
21
28
47
44
42
19
17
15
6
50
8

EQUIPMENT FOR THE REPAIR OF, IN PARTICULAR FOR CORRECTING DENTS OR BULGES IN, CONTAINERS

FIELD OF THE INVENTION

The invention relates to equipment which is suitable for the repair of, in particular for correcting dents and bulges in, containers.

BACKGROUND OF THE INVENTION

As is well known, the use of large containers for goods transport has increased enormously in the last twenty years and should also increase in the future. The container, together with loading equipment produced in the meantime, offers great advantages not only in combined transport from ship to land but also for exclusively sea or land freight.

When transferring containers, it is unavoidable that parts of the containers—be it top, bottom, side wall or end wall—are damaged by unintentional contact with neighboring containers, conveyor equipment or parts of structures, the occurrence of dents or bulges in the walls and the bending of bottom profiles being the most frequent type of damage. In order to correct this type of damage, it has previously been necessary to erect a multipart framework in the container, on which a hydraulic pressure unit is located. The framework was brought in and moved by hand and the exact positioning of the equipment was associated with a large expenditure of time and money.

Other substantial disadvantages of the existing equipment are the danger of accident and the noise occurring during the repair because alignment by means of heavy hammers was unavoidable.

The object of the present invention is to propose equipment for the repair of containers, which equipment permits rapid and low cost repairs using uncomplicated design and robust construction, it being possible to carry out the different tasks with one and the same device. The equipment in accordance with the invention is defined in the independent claim. Preferred embodiment examples are provided by the dependent claims.

BRIEF DESCRIPTION OF THE DRAWINGS

An embodiment example of the subject of the invention is described below using the attached drawings.

DETAILED DESCRIPTION

The equipment has a frame indicated in its entirety by 1, its basic framework having three branches 2,3,4 and an intermediate support 5. Four rollers 6,7,8, 9 are freely rotatably mounted on the frame branches 2, 3 and 4. A tubular construction 10 fastened to the basic framework serves, on the one hand, as a boundary and, on the other, for pushing when the frame is being moved about.

Figure 11:
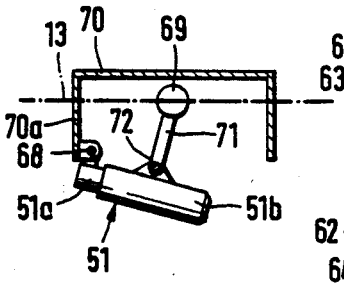
Figure 12:
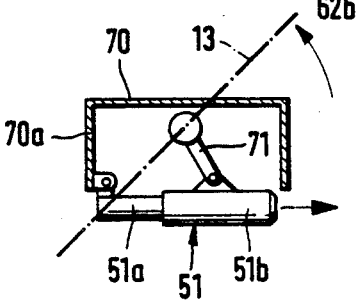
Figure 13:
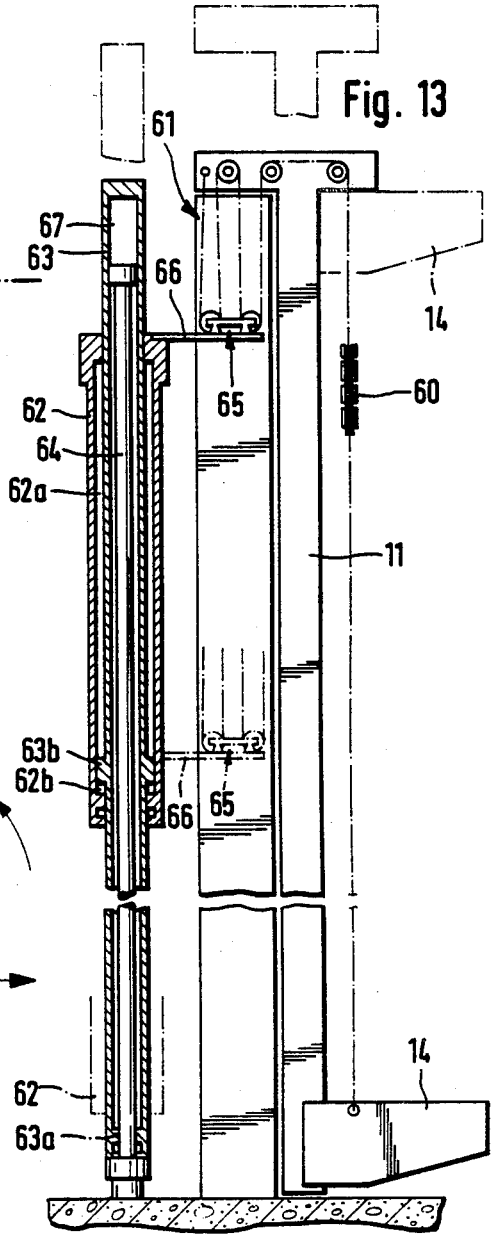

A support column 11 protrudes upwards from the intermediate support 5, which support column carries a free-stroke hydraulic unit which is not visible in this figure but is indicated by 62/63 in FIG. 13. This hydraulic unit is anchored by means of its lower part on the support column 11 and serves for raising and lowering a sliding-carriage support 12 on which a sliding carriage 14 is slidably mounted. The sliding carriage 14 (see also FIG. 13) is connected via chains 60 to a mobile cylinder 62 of the hydraulic unit. During the stroke movement, the sliding carriage 14 is first lifted by the chains 60, and the sliding-carriage support 12 with the sliding carriage and the pressure beam 13 fixed thereto then slides into the uppermost position. The sliding-carriage support 12 is thus mounted on the periphery of the support column 11 so that it can also slide vertically. The pressure beam 13 is, in its central region, rotatably mounted on the sliding carriage 14 and is coupled to a hydraulic pivoting unit 51 (FIGS. 11 and 12). Two pressure arms **13*a*, 13*b* are slidingly mounted on the periphery of the pressure beam 13. Each of these pressure arms 13*a*, 13*b* accommodates a double-acting hydraulic cylinder; each of these hydraulic cylinders is fastened at the central part of the pressure beam 13 and its piston rod is connected to the appropriate pressure arm 13*a*, 13*b*** in such a way that the two pressure arms can, as required, be driven out from the center to both sides. If appropriate, it would be also possible to provide only one pressure arm.

Figure 2:
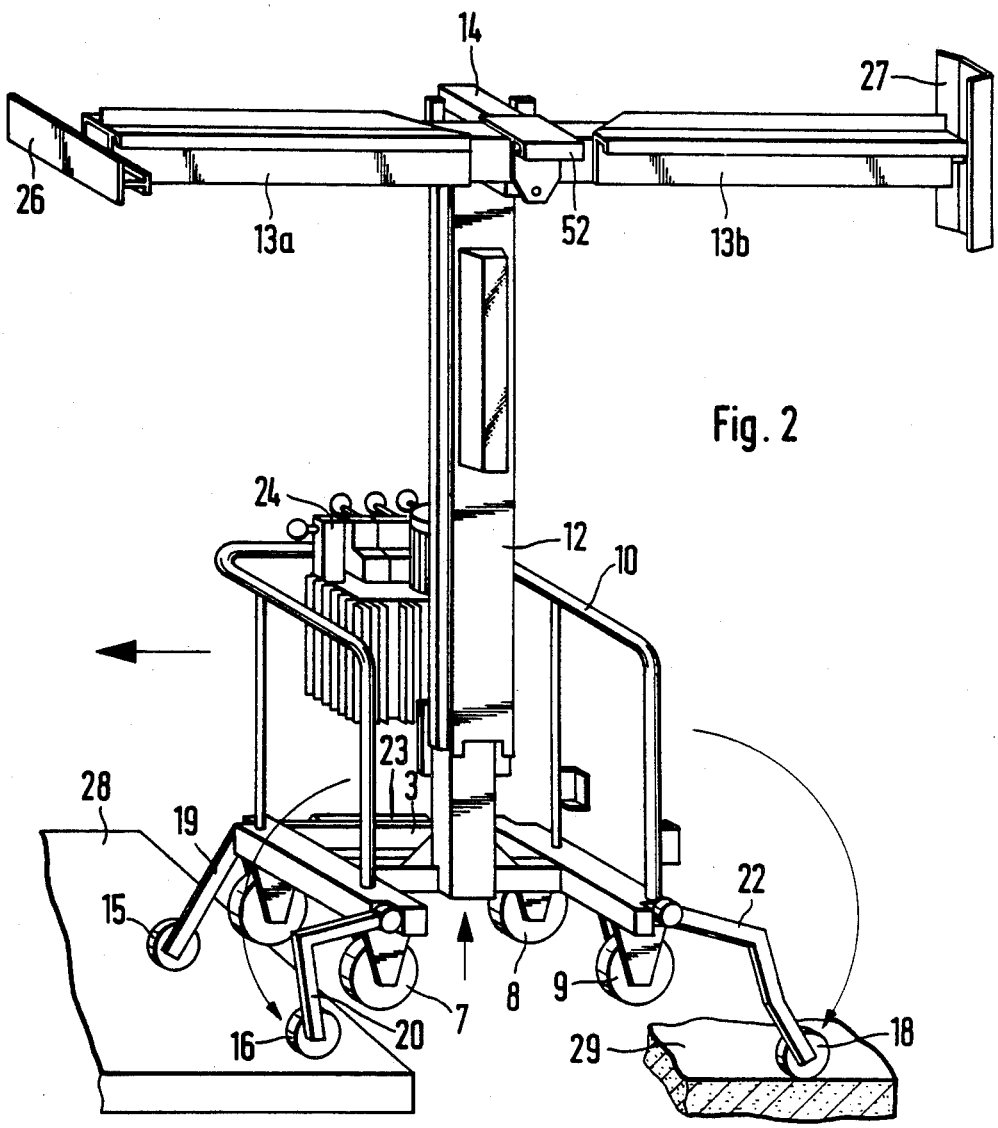

Since the equipment described operates in most cases within the container to be repaired, it is first necessary to raise the equipment from the workshop floor onto the container bottom. This takes place by means of a device, which includes four freely mounted rollers 15, 16, 17, 18, which are rotatably mounted via pivoting arms 19, 20, 21, 22 on the basic framework of the frame 1. Each pivoting arm 15–18 carries, at its lower end, a toothed segment which engages with a toothed rack located in the appropriate frame branch 2, 4, one each of the toothed segments 45, 46 (FIG. 7) engaging with one toothed rack 42 located in the appropriate frame branch 2, 4 (FIGS. 7 and 8), one toothed segment of each connected roller pair 15, 16 and 17, 18 being located in each case beneath the toothed rack 42 and the other above the toothed rack 42. This produces the result that when the toothed rack is displaced, one of the connected roller pairs 15, 16 and 17, 18 in each case is pivoted downwards about a common horizontal axis (see arrow in FIG. 2). The detailed description of this drive is given later using FIGS. 7 and 8.

The drive of the two toothed racks takes place by means of a mobile hydraulic cylinder 23 (FIGS. 2, 7, 8), which can be applied to one frame branch 3 between two stops and can be removed, as required, and also used for other purposes. A control switch **23*c* provided with two actuator buttons is provided at the hydraulic cylinder 23**.

In addition, control equipment 24 is located on the support column 11 and a lamp 25, for illuminating the working place, on the sliding-carriage support 12.

The different possiblities for applying this equipment are now described using FIGS. 1 to 6.

Figure 1:
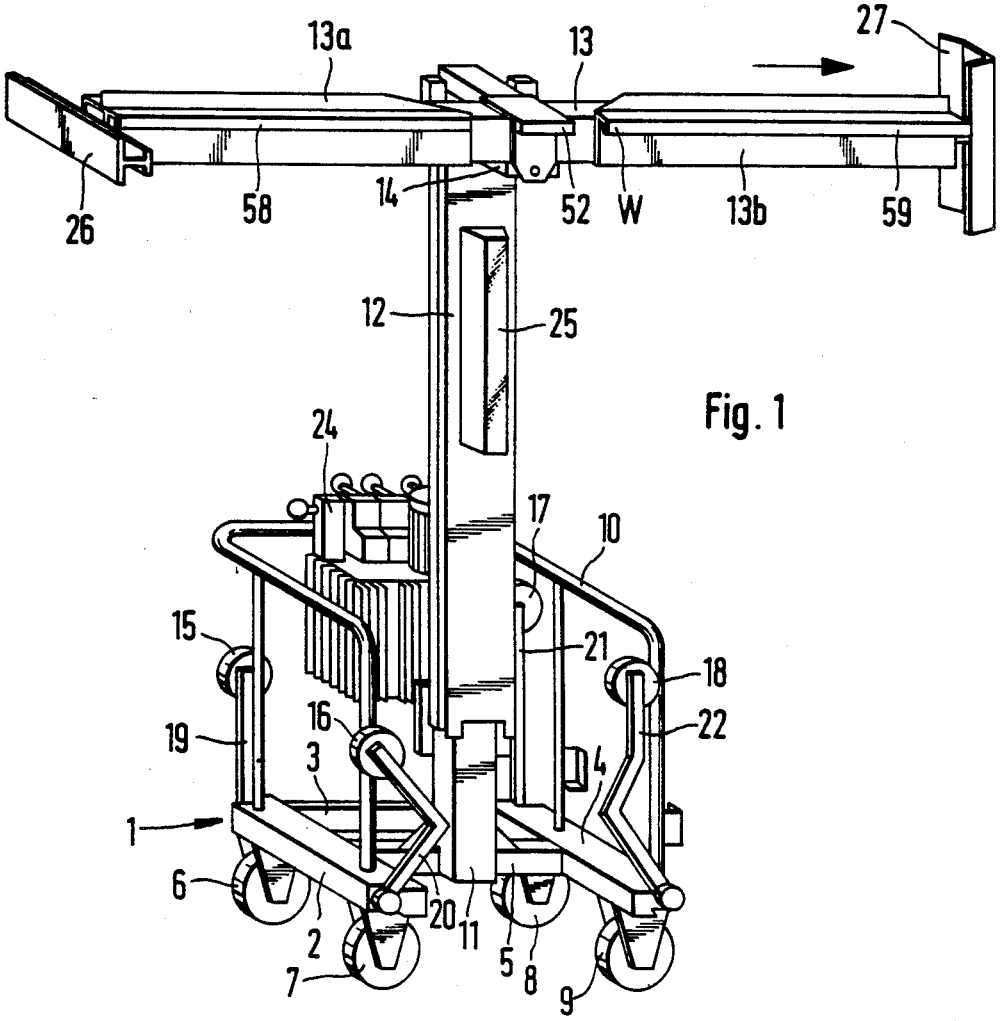
FIGS. 1 to 4 are simplified perspective representations of one embodiment form of the equipment, in accordance with the invention, in different working positions.

In accordance with FIG. 1, a horizontal support profile 26 is releasably applied to the pressure arm 13*a* while the opposite pressure arm 13*b* carries a straightening profile 27, which is matched to the contours of the container wall. If, now, the container side wall has a dent protruding inwards, the equipment is pushed to the appropriate point, the pressure beam 13 brought to the desired height by means of a drive, still to be described, (FIG. 13) and the two pressure arms 13*a*, 13*b* driven out sidewards until the support profile 26 is in contact with one side wall and the straightening profile 27 engages in the dented groove of the opposite wall. By applying an appropriate hydraulic pressure to the two pressure arms 13*a*, 13*b* the damage can then be corrected.

It is of particular advantage, in the procedure described above, that the entire equipment rests on freely rotatable wheels 6–9 and can thus give way so as to compensate for any force originating from the side walls of the container. The exact centering of the pressure arms 13*a*/13*b* is, by virtue of this equipment, an effectively automatic procedure.

If the equipment located on the workshop floor is to be brought into the container, the frame 1 is initially pushed as far as possible up to the container bottom edge, after which the two pivoting arm pairs 19, 20 and 21, 22 are pivoted sufficiently far in the direction of the arrow (FIG. 2) until the wheels 6 to 9 are above the level of the container bottom 28. The rollers 15, 16 then rest on the container bottom 28 and the rollers 17, 18 on the workshop floor 29. The equipment can now be pushed without difficulty into the container and let down onto its bottom 28, the pivoting arms then reassuming their rest position automatically in accordance with FIG. 1.

Figure 7:
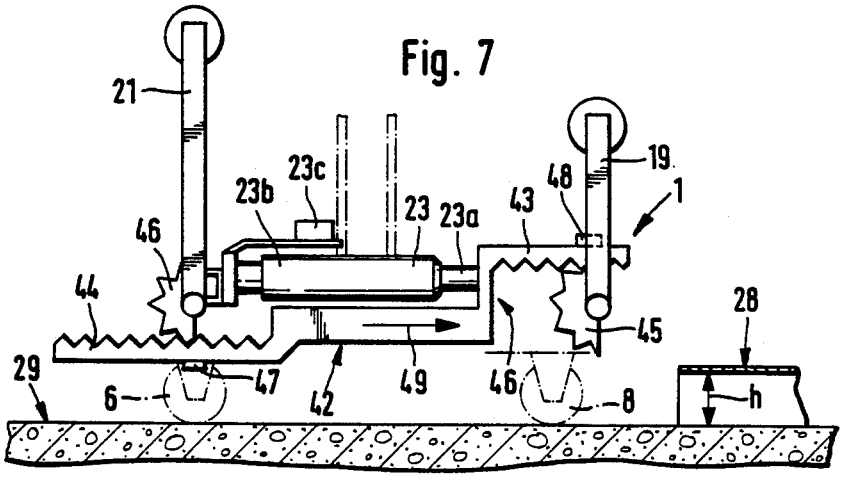
FIG. 7 is a simplified side view of the device before use.
Figure 8:
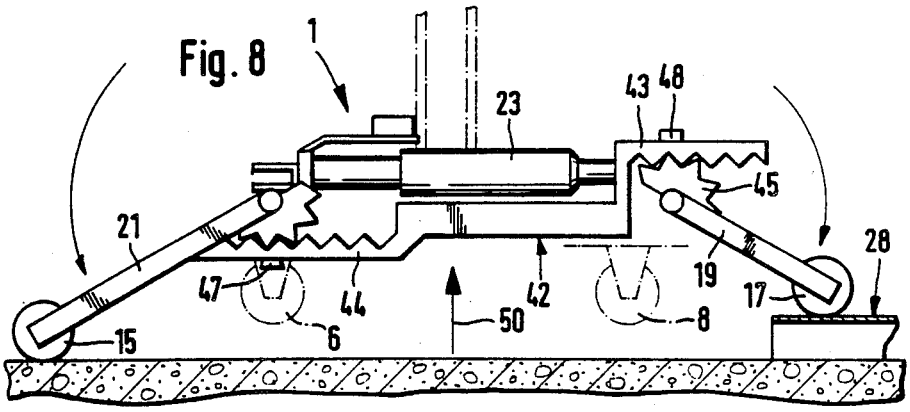
FIG. 8 shows the same device during transfer from the workshop floor into the container.

The actuation of the pivoting arm pairs 19, 20 and 21, 22 can, for example, take place in accordance with an embodiment form which is shown diagrammatically in FIGS. 7 and 8, only one pivoting arm 19 and 21 being shown in each case in these Figures for simplicity.

In accordance with FIG. 7, the frame 1 is still on the workshop floor 29 and has now to be raised onto the container bottom 28, which lies at a distance h above the workshop floor 29. For this purpose, the drive 23, in the present case a hydraulic cylinder 23*b* provided with a piston 23*a*, is connected to a toothed rack, indicated in its entirety by 42. This toothed rack is provided, in each of the regions of each of the lower ends of the two pivoting arms 19 and 21, with a toothed end section 43 and 44, respectively, the teeth of one end section 43 pointing downwards and the teeth of the opposite end section 44, in contrast, being directed upwards. The teeth of the two end sections 43 and 44 are in continuous engagement with the toothed segments 45 and 46 of the two pivoting arms 19 and 21. The toothed rack is slidably supported, in known manner, for example by sliding supports 47 and 48.

As may also be seen from FIG. 7, the pivoting arm 19 is smaller by a substantial amount than the opposite pivoting arm 21. The toothed rack 42 has an offset 46 so that the toothed segment 45 finds a position beneath the toothed rack end section 43.

On actuation of the drive 23, therefore, the piston 23*a* displaces the toothed rack 42 in the direction of the arrow 49, the pivoting arm 21 being pivoted anticlockwise and the pivoting arm 19 clockwise (see arrows in FIG. 8). With this pivoting movement, the roller 15 of the pivoting arm 21 reaches the workshop floor 29 whereas the roller 17 of the pivoting arm 19 comes in contact with the container bottom 28. With this pivoting movement, the frame 1 is raised in the direction of the arrow 50 (FIG. 8) sufficiently far for the wheels 6, 7, 8, 9, of which only the two indicated by 6 and 8 are visible in FIG. 8, to be on the level of the container bottom 28. The frame can now be displaced without difficulty until the wheels 6, 7, 8, 9 rest on the container floor 28, after which the pivoting arms 19 to 22 are pivoted back into their original position in accordance with FIG. 7. When leaving the container, the procedure described takes place in the opposite direction.

The entire equipment can, of course, also be brought into the container by hand.

Figure 3:
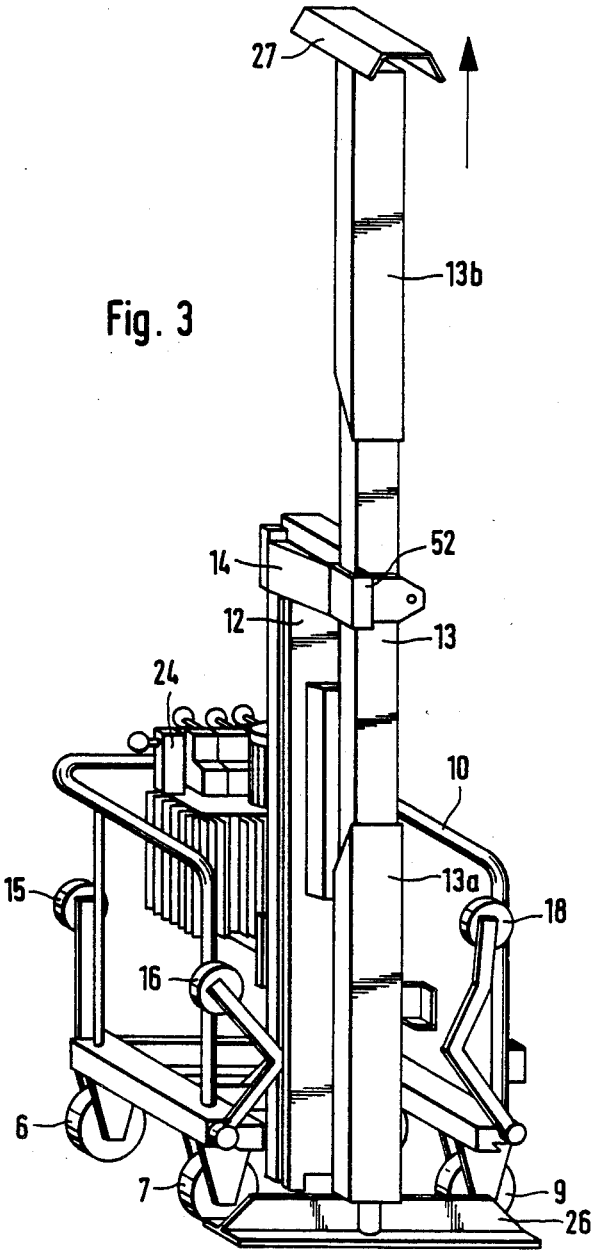

In accordance with FIG. 3, the pressure beam 13 is in its vertical position, in which damage to the top of the container can be corrected. The support profile 26 opposite to the straightening profile 27 is then supported on the bottom of the container.

Figure 4:
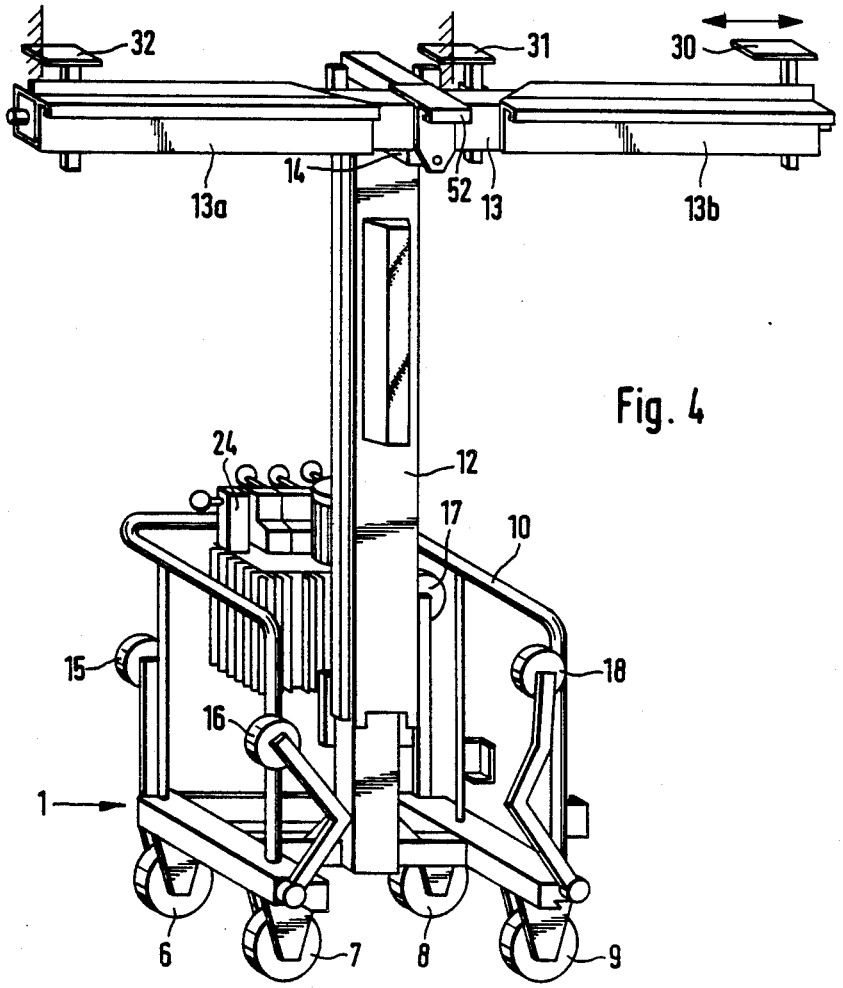

FIG. 4 shows a further use of the equipment. In this figure, an insert 30, 31, 32 is inserted in each of corresponding recesses in the two pressure arms 13*a*, 13*b* and in the central region of the pressure beam 13. The equipment is, in this case, located underneath the container which, for example, has been raised by an indoor crane onto a corresponding support frame. Deformations to the bottom profile located on the underside of the container bottom can be corrected by actuation of the pressure arms 13*a*/13*b*, one insert (for example 30) being in contact with the bottom profile section to be straightened and the other two inserts (for example 31, 32) being supported on the container bottom and taking the reaction force.

Figure 5:
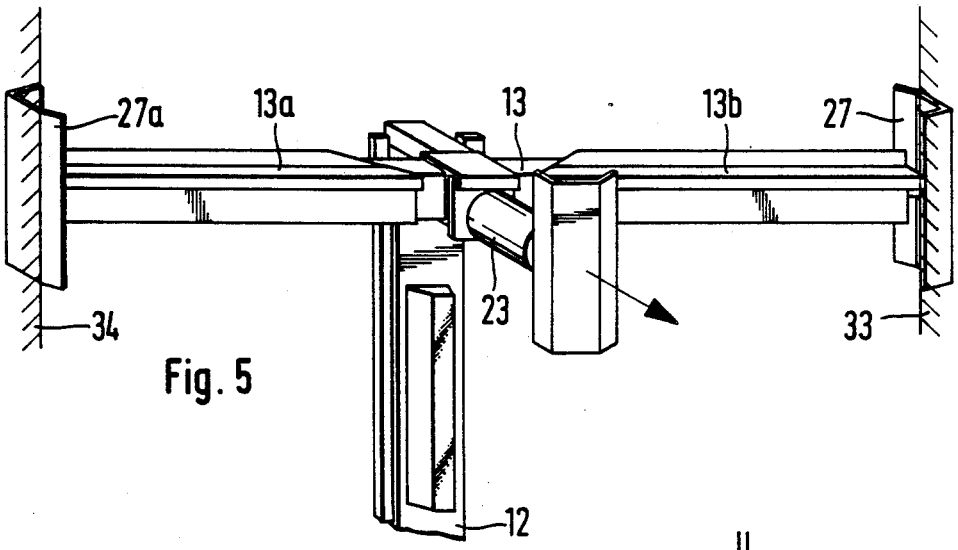
FIG. 5 shows the pressure beam in a further working position.

FIG. 5 shows the position of the pressure beam 13 when straightening an end wall running transverse to the side wall. In this application, one straightening profile 27, 27*a* is located at each of the ends of the two pressure arms 13*a*, 13*b* and both straightening profiles are pressed into the corresponding grooves of the two container side walls 33, 34 for the purpose of accepting the reaction forces arising.

Figure 9:
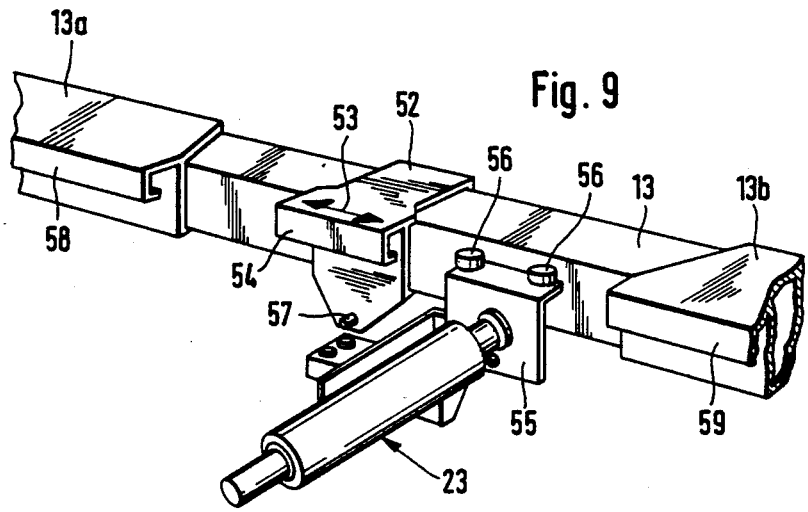
FIG. 9 is a perspective representation of the mobile hydraulic cylinder applied to the pressure beam.
Figure 10:
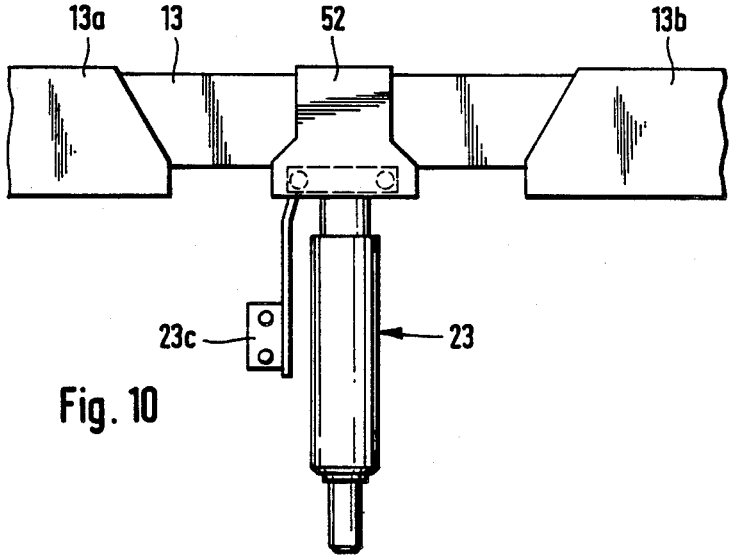
FIG. 10 is the plan view associated with FIG. 9, FIGS. 11 and 12 show the rotational drive of the working beam in two positions and FIG. 13 diagrammatically illustrates the transfer of the stroke movement of one hydraulic cylinder onto the pressure beam.

A preferred embodiment variant of such an arrangement is shown in FIGS. 9 and 10, the reference numbers already introduced being retained. The figures show the pressure beam 13, on which, as already described, the two pressure arms 13*a* and 13*b* are slidingly mounted and are connected by means of their inner ends to the hydraulic cylinders mentioned. In this embodiment, the pressure beam 13 is designed as a hollow box profile of practically square cross-section and carries, in its central region, a sliding piece 52 with free sliding support on this central region, which sliding piece is in contact with the pressure beam 13 practically on all sides and can be displaced along it in the direction of the double arrow 53. On its front, this sliding piece 52 carries a support rail 54 designed as an upright U-profile, it being possible for the mobile hydraulic cylinder 23 to hang in the support rail 54. The hydraulic cylinder carries at one end, for this purpose, an L-shaped plate 55, on whose upper leg two freely rotatably mounted rollers 56 are located. These rollers 56 are so matched in shape and size to the support rail 54 that they can be pushed into the latter, the plate 55 resting with its inner surface on a pin 57 of the sliding piece 52 and the mobile hydraulic cylinder 23 being securely supported by this means.

As may also be seen from FIG. 9, the two pressure arms 13*a* and 13*b* of the pressure beam 13 are also provided with support rails 58 and 59, in which the mobile hydraulic cylinder 23 can be inserted in the manner described and, by virtue of the two rollers 56, can be displaced to any given position as required.

The straightening profiles can, as described, be loosely placed on the pressure arms 13*a*, 13*b* and on the hydraulic cylinder 23 and are secured in this operating position by a spring loaded catch. In view of the numerous profile dimensions of the container walls, it is advisable to maintain a straightening profile store so that the necessary straightening profile is available when required.

The force transmission from the free stroke cylinder actuating the support beam to a sliding carriage carrying the support beam and being slidingly mounted on the sliding carriage support preferably takes place via a gear ratio transmission which can, for example be designed in the form of at least one chain guided by means of toothed sprockets.

An embodiment example of such a force transmission is shown diagrammatically in FIG. 13. In accordance with this arrangement, the sliding carriage 14 is connected with an external cylinder 62, which can be hydraulically supplied, by means of a chain drive 61 which includes two chains 60, of which only one is shown in FIG. 13, and an idler unit 65 consisting of chain sprockets. This external cylinder 62 is mounted on the periphery of an internal cylinder 63 so that it can be displaced vertically, a piston 64 being located in the internal cylinder 63. When the external cylinder 62 is located in the lower position, shown chain dotted, it can be displaced upwards by feeding hydraulic medium into the space 62*a*, taking with it the two idler unit sprockets, which are solidly connected with the upper edge of the external cylinder 62 by means of a support 66 so that, by this means, the idler unit wheels 65 are thereby also moved from their lower into their upper position and the beam 13 is correspondingly lowered into its fully extended position. In order to raise the pressure beam 13, the space indicated by 62*b* in FIG. 13 is correspondingly subjected to pressure medium.

The internal cylinder 63 is movable relative to the stationary piston 64 (i.e. the latter is anchored in a fixed location) and is sealed relative to the external surface of the piston 64 by an annular ring 63*a*. In its central region, this internal cylinder 63 has a further annular ring 63*b*, which serves, on the one hand, as a guide at the internal surface of the external cylinder 62 and, on the other, to divide the two pressure spaces 62*a* and 62*b*.

If the external cylinder 62 has attained its lower position, shown chain-dotted, in which the pressure beam 13, therefore, is located in its upper position, then pressure medium is introduced by an automatic control by means of a hole in the piston 64 into the upper space indicated by 67, by which means the internal cylinder 63 can be raised by a further amount. The chains 60 are then out of operation. By virtue of this two-stage stroke arrangement, the stroke height necessary for corrections to the top of the container can be attained directly.

As has already been mentioned, the pressure beam 13 can be rotated about a horizontal axis so that it can be brought from its horizontal working position into its vertical working position. A diagonal working position is also possible. An embodiment example of a drive usable for this purpose is shown in FIGS. 11 and 12. According to these, a fixed installation hydraulic cylinder 51 engages with the side flange, indicated by 70*a*, of a U-profile 70, the piston 51*a* of the hydraulic cylinder 51 being connected as a pin joint via a link 68 with the flange 70*a*; the housing 51*b* forming the cylinder is connected via a lever 71 and a link 72 to the pressure beam 13. On actuation of the hydraulic cylinder 51, its cylindrical housing 51*b* is therefore moved in the arrow direction in accordance with FIG. 12, by which means the pressure beam 13 is pivoted about a horizontal axis.

Figure 6:
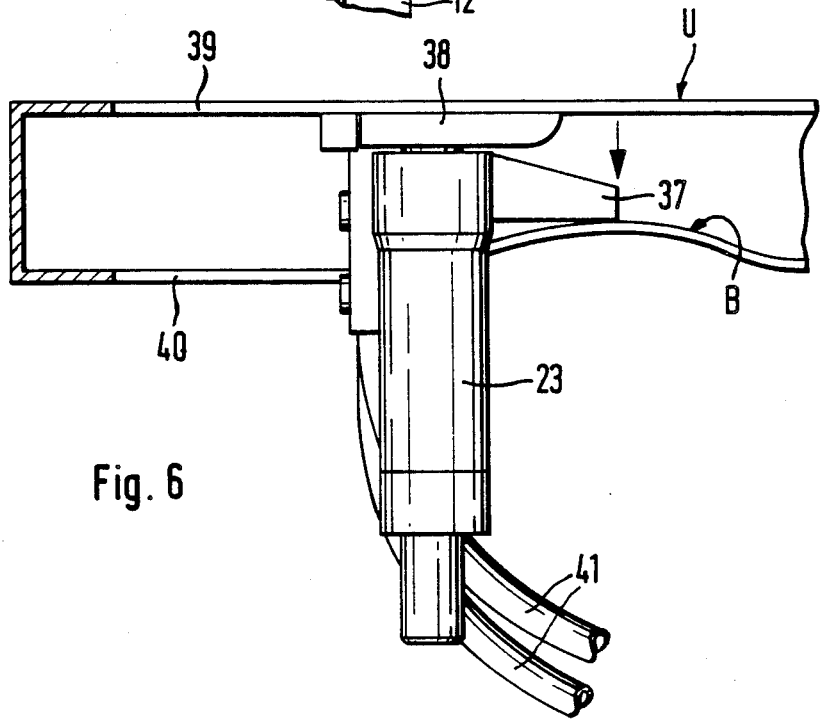
FIG. 6 illustrates one possibility of use for the mobile hydraulic cylinder.

Upright U-profiles are normally located underneath the container bottom and experience shows that these are also easily damaged. For the purpose of bending such deformations straight, the mobile hydraulic cylinder 23 has a side protrusion 37 on its housing (FIG. 6). In the working position of the hydraulic cylinder 23, this protrusion is so applied to the damaged U-profile U that the support plate 38 connected to the piston rod of the hydraulic cylinder is in contact with the upper flange 39 of the U-profile and the protrusion 37 with the lower flange 40 of the U-profile. By actuation of the hydraulics, to which the cylinder is connected via hoses 41, a dent indicated by B can, for example, be straightened.

An important function of the equipment described is that the pressure beam 13, rotatably fastened to the sliding carriage 14, can be lowered virtually to the level of the container bottom and, on the other hand, raised up to the container top. In the embodiment example described, this is accomplished by a lifting device operating in two stages: on the one hand, the sliding carriage can be moved up and down on the sliding-carriage support 12 and, on the other hand, the sliding-carriage support 12 together with the sliding carriage 14 can be shifted vertically on the support column 11. In place of such a two-stage hydraulic unit, it would also be possible to use a different lifting drive, for example an electric drive.

We claim:

1. Equipment for the repair of dents or bulges in containers, comprising:

wheel supported frame means;

a vertically upright support column fixedly mounted on said frame means;

first carriage means reciprocally mounted on said support column between upper and lower limits;

elongated beam means and first mounting means for mounting said beam means on said first carriage means, said mounting means including means defining a horizontal axis intermediate the ends of said beam means;

second and third carriage means reciprocally mounted on said beam means, one each on opposite sides of said horizontal axis, each said second and third carriage means having a container engaging tool thereon;

drive means for driving said second and third carriage means reciprocally on said beam means;

a cylinder means having a movable member thereon and second mounting means for mounting said cylinder means to said support column;

connecting means for connecting said movable member on said cylinder means to said first carriage means so that said first carriage means will travel up and down said support column in response to a movement of said movable member;

whereby said second and third carriage means and said tool thereon can be moved by said drive means into simultaneous engagement with spaced surface sections on said container, such as spaced sidewall sections or spaced top and bottom wall sections at vertical locations determined by the position of said first carriage means on said support column.

2. Equipment according to claim 1, wherein said cylinder means consists of an internal cylinder and an external cylinder encircling said internal cylinder and defining said movable member, and a vertically stationary piston slidably located in said internal cylinder, and wherein said connecting means includes two chains for connecting said first carriage means to said external cylinder and a chain idler unit which is fixedly attached to the upper end of said external cylinder, whereby a displacement of the external cylinder between its lower and upper position relative to said internal cylinder raises and lowers said beam means with respect to said carriage support and a displacement of the internal cylinder relative to said piston with said external cylinder in its lower position raises and lowers said beam means with respect to said support column by a further amount.

3. Equipment according to claim 1, wherein said horizontal axis divides said beam means into two arms, each of said arms having a front-mounted support rail in which a mobile hydraulic cylinder can be inserted and displaced to any given point on said beam means, and wherein said mobile hydraulic cylinder is provided with rollers, permitting the latter to hang releasably in said support rails, each of the two said support rails having an upright U-profile, which is matched to the size of said rollers.

4. Equipment according to claim 3, wherein a sliding piece, which is freely displaceable on said beam means, is located in the central region of the latter serving as a holding device for said mobile hydraulic cylinder, said sliding piece also having a support rail designed as a U-profile.

5. Equipment according to claim 1, wherein for adjusting the working position of said beam means when in a normally horizontally aligned position, a drive is provided consisting of a hydraulic cylinder located at the lower part of said first carriage means, which hydraulic cylinder is connected via a lever to a pivot pin on said beam means.

6. Equipment according to claim 1, wherein on the lower part of said frame means, at least two freely rotatable rollers are mounted on pivoting arms, being pivotable about a horizontal axis and coupled to a drive in such a way that said rollers can be lowered onto a container bottom by a first action of said drive and, on further action of said drive, can lift said frame means sufficiently far for the latter to be displaced with said wheels onto the bottom of the container.

7. Equipment according to claim 6, wherein said frame means is provided with two rollers mounted on pivoting arms on each of two mutually opposite sides.

8. Equipment according to claim 7, wherein each pivoting arm has a toothed segment at an end opposite to said roller, which toothed segment engages with a toothed rack which can be moved forwards and backwards and which is coupled to said drive, and wherein said toothed rack having teeth which are directed downwards at one of its end sections and upwards at the opposite end section, with the objective of pivoting said pivoting arms, engaging via toothed segments with said two end sections, in opposite rotational directions when said drive is actuated.

9. Equipment according to claim 8, wherein said pivoting arms located at mutually opposite sides of said frame means are of different lengths and said toothed rack has at least one offset.

10. Equipment according to claim 6, wherein said drive is a mobile hydraulic cylinder which, in its working position on said frame means, is inserted between two buffers so as to be freely removable in such a way that this hydraulic cylinder can also be applied at other locations on the frame on correspondingly located holding devices.

11. Equipment according to claim 10, wherein said mobile hydraulic cylinder has a side protrusion in such a way that the upper part of said hydraulic cylinder can be put under load with said protrusion between two flanges of a U-profile for the purpose of straightening the latter.

12. Equipment according to claim 1, wherein said horizontal axis divides said beam means into two arms, wherein on each arm at least one acceptance part for fastening a buffer, vertically insertable on said arm in its horizontal position, is provided for the purpose of straightening bent bottom profiles.

* * * * *